US006042661A

United States Patent [19]

Dunand et al.

[11] Patent Number: 6,042,661

[45] Date of Patent: Mar. 28, 2000

[54] CHEMICALLY INDUCED SUPERPLASTIC DEFORMATION

[75] Inventors: David C. Dunand; Peter Zwigl, both of Evanston, Ill.

[73] Assignee: Massachusetts Institute of Technology, Cambridge, Mass.

[21] Appl. No.: 08/820,768

[22] Filed: Mar. 19, 1997

[51] Int. Cl.[7] ..... C22F 1/00

[52] U.S. Cl. ..... 148/564; 148/669

[58] Field of Search ..... 148/564, 669

[56] References Cited

U.S. PATENT DOCUMENTS

| | | | |
|---|---|---|---|
| 4,263,375 | 4/1981 | Elrod | 428/594 |
| 4,415,375 | 11/1983 | Lederich et al. | 148/564 |
| 4,505,764 | 3/1985 | Smickley et al. | 148/670 |
| 4,822,432 | 4/1989 | Eylon et al. | 148/669 |
| 4,982,893 | 1/1991 | Ruckle et al. | 228/220 |
| 5,413,649 | 5/1995 | Dunand et al. | 148/564 |
| 5,447,582 | 9/1995 | Eylong et al. | 148/669 |
| 5,630,890 | 5/1997 | Smashey et al. | 148/669 |

OTHER PUBLICATIONS

F.H. Froes et al., "Thermochemical Processing of Titanium Alloys," *Journal of Metals*, 26–47 (1990).

O.N. Senkov et al., "Recent Advances in the Thermohydrogen Processing of Titanium Alloys," *Journal of Metals*, 42–47 (1996).

*Primary Examiner*—George Wyszomierski

[57] ABSTRACT

The invention produces superplastic deformation in a workpiece by altering the chemical composition of the workpiece material, while the workpiece is subjected to a biasing stress, in a manner that introduces a strain increment into the material that effects a change in a overall dimension of the workpiece without causing failure. In one approach, repeated cyclic alteration of chemical composition, so as to repeatedly alternately induce and reverse a phase transition that produces strain increment, allows accumulation of strain in an incremental fashion thereby achieving large overall superplastic deformations in the workpiece without applying large stresses.

43 Claims, 2 Drawing Sheets

CHEMICALLY INDUCED SUPERPLASTIC DEFORMATION

This invention was made with government support under United States Army contract #DAAH04-95-1-0629. The government has certain rights in this invention.

FIELD OF THE INVENTION

This invention relates to superplastic deformation. More particularly, this invention relates to a technique for inducing superplastic deformation by chemical means.

BACKGROUND OF THE INVENTION

Superplastic deformation is defined as the deformation of a workpiece to a very large strain by application of a small stress without disrupting the mechanical integrity of the workpiece. Although superplastic deformation is universally characterizable by the formula $$\dot{\varepsilon} = A\sigma^n \exp\left(\frac{-Q}{RT}\right)$$

(in which $\dot{\epsilon}$ is strain rate, A is a materials constant, $\sigma$is stress, R is the gas constant, T is temperature and n is a stress exponent between one and two), this behavior can be produced by any of several different mechanisms. This phenomenon has been exploited in superplastic forming techniques. For example, titanium-based materials are desirable for their specific strength and stiffness at ambient and elevated temperatures but have high resistance to deformation at temperatures appropriate for traditional hot-working operations. However, titanium alloys having a fine, stable grain structure deforms superplastically, a phenomenon known as "fine-grain superplasticity". Titanium-forming techniques based on fine-grain superplasticity only operate successfully within a restricted window of process parameter values. For example, only small strain rates can be imposed, so the process output rate is limited. The deformation mechanism requires that grain size be maintained within certain limits throughout the deformation process.

In another superplastic mechanism, called "transformation superplasticity" (described, e.g., in U.S. Pat. No. 5,413,649, the entire disclosure of which is incorporated herein by reference), the workpiece is cycled through a phase transformation by changing the temperature. The technique is advantageous compared to earlier approaches in that it is not limited to a workpiece material with a fine-grain microstructure and the grain growth limitation is relaxed. Also, the higher strain rates achievable result in more efficient process output. However, prolonged residence at high temperatures as required for some thermal cycling procedures can promote grain growth to sizes deleterious to the mechanical properties of the finished product. Implementing the required temperature cycling capability can be costly and difficult. Also, repeated thermal cycling can promote fatigue of the treatment apparatus.

DESCRIPTION OF THE INVENTION

OBJECTS OF THE INVENTION

An object of the invention is, accordingly, to provide a technique for inducing superplasticity that is applicable to a wide range of workpiece materials, including titanium-based materials.

Another object of the invention is to provide a technique for inducing superplasticity that is not limited to any specific workpiece microstructure or composition.

Another object of the invention is to provide a technique for forming composites.

Another object of the invention is to provide a method of inducing transformation superplasticity without thermal cycling.

Another object of the invention is to provide a method of inducing superplasticity that allows fast deformation of the workpiece.

Still another object of the invention is to provide a method of inducing superplasticity that may be applied repeatedly to a workpiece with accumulation of deformation from each repetition.

BRIEF SUMMARY OF THE INVENTION

The method of the invention produces superplastic deformation in a workpiece by altering the chemical composition of the workpiece material, while the workpiece is subjected to a biasing stress, in a manner that introduces a strain increment into the material and thereby effects a change in a overall dimension of the workpiece, without causing failure. Depending on the material, the strain increment can be greater than 0.5% or 1%, even as much as 1.5% and greater. Known apparatus for fine-grain superplastic forming can be modified in a straightforward manner to incorporate the method of the invention by adding a mechanism for introducing and/or withdrawing a chemical component to effect the desired chemical composition change. The present invention may also be used for compacting a workpiece initially comprising several distinct bodies (e.g., powder, wires, foils) to form a dense article or for foaming a workpiece by the expansion of internal cavities.

The alteration in composition may be monotonic, either resulting in a permanent change in the concentration of the component or reversed after completion of the superplastic deformation process. Or the alteration may be cyclic, comprising an initial increase or decrease in the concentration of the chemical component, followed by a partial or total reversal of the initial change while the workpiece remains subject to the biasing stress.

In one approach, the composition changes within a single-phase stability field, a concomitant change in lattice strain producing the strain increment without phase transformation. In another approach, the alteration in composition induces a phase transition that gives rise to the strain increment.

Such a change in composition in the material may affect all of the workpiece material or only a part of it. The overall deformation is usually proportional to the fraction of the workpiece involved in the alteration. As used in this document, the term "segment" refers to the portion of the workpiece material undergoing a composition change and/or a phase transformation, whether it corresponds to the entire workpiece or not. The segment may, for example, form a continuous layer surrounding an unaltered core or be a collection of distinct isolated regions, each surrounded by unaltered material. In the case of phase transition, each forward or reverse transformation changes the transformed segment with respect to some aspect—its specific volume or, in some instances, some geometric aspect such as lattice type, lattice orientation or shape—so that the transformation generates an internal transformation stress in the material. In the case of chemical composition cycling it is usually desirable that the segment transformed by the reverse transformation correspond to that transformed by the forward transformation, so that the original phase constitution of the material is completely restored. However, the invention does not require such a correspondence; some of the material may remain in the forward-transformed state at the end of a cycle.

The transformations may occur along a macroscopic transformation front between an original phase in the material and a new phase in the material, originating in the reaction where the chemical composition change is introduced and advancing into the material in an organized fashion; or they may arise simultaneously at several discrete sites, having phase boundaries that move in random directions during transformation.

The scope of the invention is not limited with respect to type of phase transition or workpiece material. The phase transition may involve precipitation of a compound due to solute saturation or be, for example, allotropic, martensitic, peritectoid or eutectoid in nature. The method of the invention is compatible with, but not limited to, metallic ionic and covalent materials including pure metals and alloys, such as intermetallics, ceramic, polymeric or geologic workpiece materials.

The biasing stress influences the orientation of the strain increment to produce the desired superplastic deformation. The biasing stress may originate in a source either internal to or external to the sample; or, both internal and external sources may contribute to the bias. Residual internal stress in the workpiece may provide the biasing stress or, the transformation stress of the phase transition may itself give rise to the bias. In a preferred embodiment, the bias is provided by an externally applied stress, the magnitude of which is chosen according to the strength of the material. Depending on the deformation desired, the externally applied biasing stress may be hydrostatic or nonhydrostatic, such as a uniaxial or multiaxial stress. Such stresses may include tensile, compressive, noncompressive, torsional or bending stresses as are conventionally used to effect, for example, drawing, punching, stamping, extruding, rolling, pulling, bending, and twisting.

In a preferred embodiment, chemical composition cycling is applied to the workpiece repeatedly, each repetition introducing a strain increment. Repetitive cycling in a manner that causes the alternate induction or reversal of a phase transition to repeat is especially beneficial. The strain increment per cycle may be as much as 1.5%, or greater. The accumulation of strain in this incremental fashion allows achievement of large overall superplastic deformations in the workpiece without applying large stresses, which would risk disruption of the mechanical integrity of the workpiece. The invention does not require that a chemical composition change applied or segment affected in any given cycle correspond exactly to that transformed in any other cycle of a repetitive series.

Although the invention is applicable to a wide range of workpiece materials, alterable by a commensurately broad range of compositional changes, superplastic deformation is most efficiently accomplished if the compositional change is imposed by varying the concentration of a chemical component that has a high diffusivity in the workpiece material before and after the ensuing phase transformation. As a practical matter, it is desirable that the component be easily transportable to and removable from the surface of the workpiece. It is thus preferable that the chemical component be transported in the gas phase or produced by reaction at the workpiece of a species delivered in the gas phase. Such a component can then be removed by exposing the workpiece to vacuum or to another gas with zero or reduced pressure of the component, or by providing a getter to absorb the gaseous species. It is further preferable that small changes in the concentration of the chemical component produce a significant strain increment.

Using the method of the invention, it is possible to obtain the superplastic effects of phase transformations previously exploited by thermal cycling—such as allotropic phase transformation between a lower-temperature phase and a higher-temperature phase—without deliberate imposition of heating or cooling operations. This approach simplifies the control equipment required to operate the treatment apparatus and decreases its energy consumption. Related benefits are reduced risk of thermal fatigue of the treatment apparatus and reduced risk of undesirable grain growth in the workpiece material.

Introduction of an alloying element that shifts the composition of the original material sufficiently so that at least some of the original material converts to a different allotropic form is one way to induce a phase transition in accordance with the invention. For example, hydrogen, vanadium and niobium are known to be beta-phase stabilizers for titanium. Adding such a stabilizer to titanium produces an alloy having a lower transus temperature between the lower-temperature alpha phase and the higher-temperature beta phase than the transus for pure titanium (about 882° C.). Consequently, adding a sufficient amount of beta stabilizer to alpha-phase titanium causes at least some of the alpha-phase material to transform to the beta phase, with an attendant change in specific volume of the transformed material. Removing the beta-stabilizer from the material reverses the transformation. In a preferred embodiment, superplasticity is induced in a titanium-based workpiece material by changing the concentration of hydrogen therein.

The invention is not limited to transformations accessible by the thermal pathways of the prior art but also enables superplastic behavior to be induced by other transformations, not accessible through temperature change alone. The method of the invention is generally applicable to materials susceptible upon change in chemical composition to a phase transformation that generates the strain increment. Some such cycles may be executable isothermally. However, the method of the invention also encompasses process pathways that include temperature change in addition to the chemical cycling, whether the temperature change occurs simultaneously with or sequentially to the chemical change. The thermal variation may be actively imposed on the workpiece or originate within the workpiece due to the imposed change in chemical concentration.

In a preferred embodiment, hydrogen concentration is changed in a titanium-based material to cause alternate precipitation and dissolution of a second, titanium hydride phase. Titanium hydride precipitates when hydrogen is added to titanium in excess of the hydrogen solid solubility limit. The relatively high specific volume of the hydride phase translates into a molar volume mismatch on the order of 17% with respect to the original titanium. The volume mismatch generates sufficient internal stress to produce very large superplastic deformation. In one embodiment, the original workpiece material comprises a single phase. In an alternative embodiment, the workpiece material is a multiphase composite including a matrix of one or more phases and one or more additional phases. In a preferred embodiment, the change in chemical composition of the workpiece material alternately induces and reverses a phase transition in one or more transformable phases, which may be an additional phase or part of the matrix. The composite may also include one or more phases not subject to phase transformation upon the change in chemical composition.

The phase distribution is selected so as to allow forward and reverse phase transformation without interfacial decohesion. Bonding between the composite's phases may contribute to the internal stress caused by the phase transition.

BRIEF DESCRIPTION OF THE DRAWINGS

The foregoing discussion will be understood more readily from the following detailed description of the invention, when taken in conjunction with the accompanying drawings.

DETAILED DESCRIPTION OF THE PREFERRED EMBODIMENT

Figure 1:
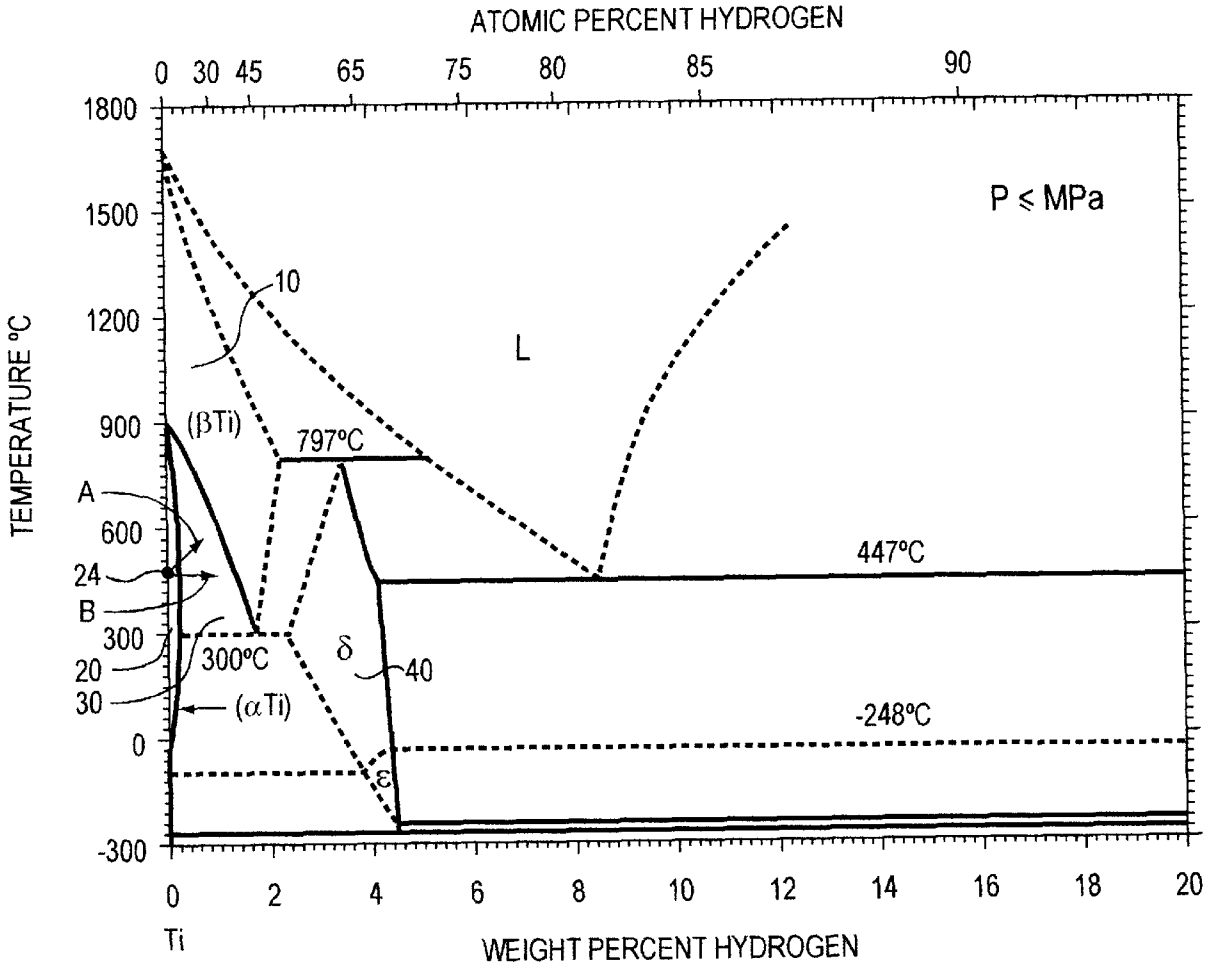
FIG. 1 is a portion of the phase diagram for the titanium-hydrogen system.

The use of hydrogen concentration cycling to induce superplasticity in a titanium-based material is demonstrated with reference to FIG. 1. In pure, hydrogen-free titanium the alpha and beta phases exist over mutually distinct temperature ranges separated by the transus temperature of 882° C. At nonzero concentrations of hydrogen in titanium, the stability field 10 of the higher-temperature beta phase extends to temperatures lower than 882° C. and overlaps the temperature range of the stability field 20 of the lower-temperature alpha phase. Increasing the hydrogen concentration of a volume of alpha-phase material initially in a state 24—either along direction A or isothermally along direction B—into the two-phase field 30 causes conversion of a segment of the alpha-phase volume to the beta phase. The extent of the segment increases with the overall hydrogen content of the volume until its composition lies in the beta phase field 10.

Figure 2:
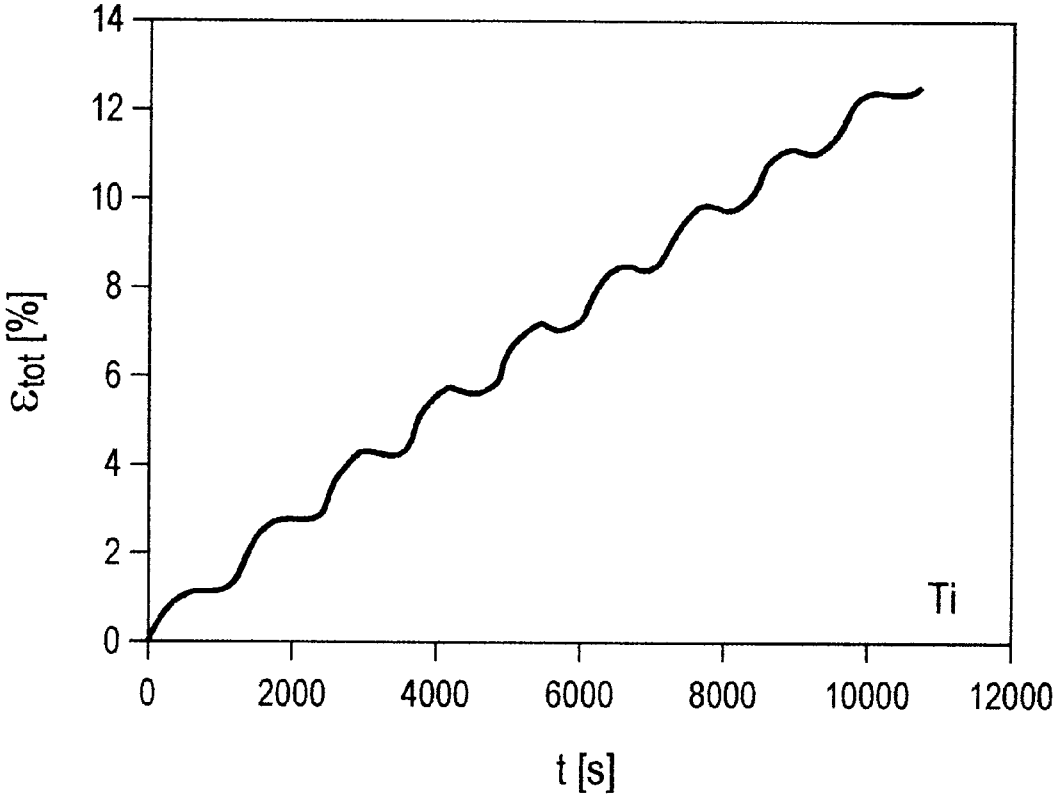
FIG. 2 graphically depicts the accumulation of superplastic strain in a titanium workpiece under tensile stress during hydrogen cycling.

A nominally pure titanium sample was superplastically deformed by chemically induced alpha-beta transformation. The sample was brought to 808° C. by radiative heating. The sample was held in an argon environment and, within the alpha stability field 20 well below the transus temperature, subjected to a uniaxial tensile stress of 2.5 MPa. Hydrogen was then provided to the heated sample in tension by adding 4% hydrogen gas in the argon stream. This gas-phase hydrogen concentration was maintained for 600 seconds, after which hydrogen was withdrawn from the sample by restoring the pure argon stream for 600 seconds. FIG. 2 shows the strain increment present after this 1200 second cycle due to the difference in specific volume between the alpha and beta phases. A total of nine hydrogen concentration cycles were applied to the sample in tension which was maintained at a constant temperature throughout the cycling. As illustrated in FIG. 2, additional strain accumulates with each cycle. The total strain was over 12%, corresponding to about 1.4% per cycle, which is much greater than deformations seen in identical samples maintained under the same conditions in an argon or argon-hydrogen atmosphere without chemical cycling.

Many variations of this process are within the scope of the invention. For titanium, a tensile stress up to about 10 MPa or even higher may be used, the strain introduced per cycle increasing with applied stress. Additional steps may be included. For example, when the desired deformation has been achieved, residual hydrogen may be removed by vacuum annealing if desired.

Chemically induced superplasticity using hydrogen is also appropriate for workpiece materials other than pure titanium. For example, hydrogen similarly affects phase relationships in titanium-based materials, for example titanium alloys such as Ti6Al4V. Other allotropic metals such as zirconium, neodymium, lanthanum, strontium, and uranium and their alloys also show phase relationships that allow chemical induction of superplasticity by cycling hydrogen concentration. Allotropic and nonallotropic metals that form hydrides with mismatch with respect to the host metal matrix—such as titanium, zirconium, niobium, tantalum and vanadium—are deformable through chemically induced superplasticity by addition of hydrogen under hydride-forming conditions. In the case of titanium, such a process converts a segment of the workpiece to the delta phase, which, with reference again to FIG. 1, has single-phase stability field 40. (This approach is easily combined with microstructure refinement of titanium, by cyclic hydriding and dehydriding, for improving its room-temperature properties.)

Chemical composition may also be changed reversibly using nitrogen or oxygen in materials based on, respectively, nitride or oxide ceramics, or based on allotropic metals such as iron, titanium, zirconium, and yttrium. Carbon may be delivered to an iron-based workpiece material by a gas such as methane and then removed by reaction with a gas such as hydrogen or oxygen.

It will therefore be seen that the foregoing represents a highly advantageous approach to inducing superplastic deformation. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. A method of inducing superplasticity in a workpiece, the workpiece being of a material susceptible to a phase transformation, upon change in concentration therein of a chemical component and at a temperature, the method comprising the steps of:

a. bringing the workpiece to the temperature; and b. alternately providing the chemical component to and removing the chemical component from the workpiece while the workpiece is subject to a biasing stress, thereby alternately inducing and reversing the phase transition to introduce a strain increment and produce a change in an overall dimension of the workpiece, due to the strain increment, of at least 0.5%.

2. The method of claim 1 wherein a cycle of inducing and reversing the phase transition produces a change of at least one-half percent in an overall dimension of the workpiece.

3. The method of claim 2 wherein the biasing stress is tensile.

4. The method of claim 1 further comprising repeating step b. at least once, each repetition introducing a strain increment, the change in the overall dimension of the workpiece being due to accumulation of strain increments, the change in an overall dimension of the workpiece corresponding to an average strain increment of at least one-half percent per repetition.

5. The method of claim 4 wherein the biasing stress is tensile.

6. The method of claim 4 wherein the phase transition comprises formation of a compound containing an element of the chemical component and an element of the material, the alternate provision and removal of the chemical component alternately forming and dissolving the compound, the change in an overall dimension of the workpiece corresponding to an average strain increment of at least 1.5% per repetition.

7. The method of claim 1 wherein the change in the overall dimension is at least 1.0%.

8. The method of claim 1 wherein the change in the overall dimension is at least 1.5%.

9. The method of claim 1 further comprising repeating at least once the alternate provision of the chemical component to and removal of the chemical component from the workpiece while the workpiece is subject to a biasing stress, each repetition introducing a strain increment, the change in the overall dimension of the workpiece being due to accumulation of strain increments.

10. The method of claim 9 wherein the change in the overall dimension of the workpiece is at least 1.5%.

11. The method of claim 9 wherein the change in the overall dimension of the workpiece is at least 12%.

12. The method of claim 1 further comprising repeating at least once the alternate provision of the chemical component to and removal of the chemical component from the workpiece while the workpiece is subject to a biasing stress, each repetition introducing a strain increment, the change in the overall dimension of the workpiece being due to accumulation of strain increments and equal to at least 1.5% per repetition.

13. The method of claim 1 further comprising repeating at least once the alternate provision of the chemical component to and removal of the chemical component from the workpiece while the workpiece is subject to a biasing stress, each repetition introducing a strain increment, the change in the overall dimension of the workpiece being due to accumulation of strain increments and equal to at least 0.5% per repetition.

14. The method of claim 1 wherein the biasing stress is noncompressive.

15. The method of claim 1 wherein the biasing stress is tensile.

16. A method of inducing superplasticity in a workpiece, the workpiece being of a material susceptible to a phase transformation, upon change in concentration therein of a chemical component and at a temperature, the phase transformation comprising formation of a compound containing an element of the chemical component and an element of the material, the method comprising the steps of:

a. bringing the workpiece to the temperature; and b. alternately providing the chemical component to and removing the chemical component from the workpiece while the workpiece is subject to a tensile biasing stress, thereby alternately forming and dissolving the compound to introduce a strain increment and produce a change in an overall dimension of the workpiece due to the strain increment.

17. The method of claim 16 wherein the compound is a hydride.

18. The method of claim 17 wherein the compound is a titanium hydride.

19. The method of claim 17 wherein the material includes a phase of niobium, tantalum or vanadium or of an alloy based thereon.

20. The method of claim 17 wherein the material includes a phase of zirconium or of an alloy based thereon.

21. The method of claim 16 further comprising repeating step b. at least once, each repetition introducing a strain increment, the change in the overall dimension of the workpiece being due to accumulation of strain increments.

22. A method of inducing superplasticity in a workpiece, the workpiece being of a material susceptible to a phase transformation, upon change in concentration therein of a chemical component and at a temperature, the method comprising the steps of:

a. bringing the workpiece to the temperature; and b. alternately providing the chemical component to and removing the chemical component from the workpiece while the workpiece is subject to a tensile biasing stress, thereby alternately inducing and reversing the phase transition to introduce a strain increment and produce a change in an overall dimension of the workpiece due to the strain increment.

23. The method of claim 22 further comprising repeating step b. at least once, each repetition introducing a strain increment, the change in the overall dimension of the workpiece being due to accumulation of strain increments.

24. The method of claim 23 wherein the workpiece is of a titanium-based material, the component being hydrogen.

25. The method of claim 22 further comprising the step of shaping the workpiece to produce a change in shape of the workpiece by accumulation of superplastic strain increments.

26. The method of claim 22 wherein the workpiece is of a composite material comprising a matrix and one or more additional phases, the composite material having a transformable phase susceptible to a phase transition upon change in concentration therein of a chemical component at a temperature, the alternate provision and removal of the chemical component alternately inducing and reversing the phase transition in the transformable phase.

27. A method of inducing superplasticity in a workpiece, the workpiece being of a material susceptible to a phase transformation, upon change in concentration therein of a chemical component and at a temperature, the method comprising the steps of:

a. bringing the workpiece to the temperature;

b. applying an external tensile stress of at least 2.5 MPa to the workpiece to subject the workpiece to a biasing stress; and c. alternately providing the chemical component to and removing the chemical component from the workpiece while the workpiece is subject to the tensile biasing stress, thereby alternately inducing and reversing the phase transition to introduce a strain increment and produce a change in an overall dimension of the workpiece due to the strain increment.

28. The method of claim 27 wherein the external tensile stress is at least 10 Mpa.

29. A method of inducing superplasticity in a workpiece, the workpiece being of a material susceptible to a phase transition, upon change in concentration therein of a chemical component and at a temperature, the method comprising the steps of:

a. bringing the workpiece to the temperature; and b. alternately providing the chemical component to and removing the chemical component from the workpiece while the workpiece is subject to a noncompressive biasing stress, thereby alternately inducing and reversing the phase transition, in a manner that introduces a strain increment and produces a change in an overall dimension of the workpiece due to the strain increment.

30. The method of claim 29 further comprising the steps of:

a. repeating at least once the step of alternately providing the chemical component to and removing the chemical component from the workpiece comprises, thereby repeatedly inducing and reversing the phase transition, so that each repetition introduces a superplastic strain increment; and b. shaping the workpiece to produce a change in shape of the workpiece by accumulation of superplastic strain increments.

31. The method of claim 29 wherein the workpiece is of a composite material comprising a matrix and one or more additional phases, the composite material having a transformable phase susceptible to the phase transition upon change in concentration therein of the chemical component at the temperature.

32. The method of claim 29 wherein the workpiece is of a titanium-based material susceptible to the phase transition at a temperature, the chemical component being hydrogen.

33. The method of claim 29 wherein the phase transition comprises formation of a compound containing an element of the chemical component and an element of the material, the alternate provision and removal of the chemical component alternately forming and dissolving the compound.

34. A method of inducing superplasticity in a workpiece comprising a material, the method comprising altering the concentration in the workpiece of a chemical component while the workpiece is subject to a noncompressive biasing stress, thereby introducing a strain increment into the workpiece and producing a change in an overall dimension of the workpiece due to the strain increment.

35. A method of inducing superplasticity in a workpiece comprising a material, the method comprising altering the concentration in the workpiece of a chemical component while the workpiece is subject to a biasing stress, thereby introducing a strain increment into the workpiece and producing a change in an overall dimension of the workpiece due to the strain increment, said change in an overall dimension of the workpiece comprises expanding internal cavities in the workpiece, thereby foaming the material.

36. The method of claim 35 wherein the workpiece is of a material susceptible to a phase transition, upon change in concentration therein of the chemical component and at a temperature, further comprising the step of bringing the workpiece to the temperature, altering the concentration in the workpiece of a chemical component comprising alternately providing the chemical component to and removing the chemical component from the workpiece.

37. A method of inducing superplasticity in a workpiece comprising a material, the method comprising altering the concentration in the workpiece of carbon while the workpiece is subject to a biasing stress, thereby introducing a strain increment into the workpiece and producing a change in an overall dimension of the workpiece due to the strain increment.

38. The method of claim 37 wherein the workpiece is of a material susceptible to a phase transition, upon change in concentration therein of carbon and at a temperature, further comprising the step of bringing the workpiece to the temperature, altering the concentration in the workpiece of carbon comprising alternately providing carbon to and removing carbon from the workpiece.

39. The method of claim 38 wherein the material includes a phase of iron or of an alloy based thereon.

40. A method of inducing superplasticity in a workpiece comprising a material, the method comprising altering the concentration in the workpiece of a chemical component while the workpiece is subject to a biasing stress, thereby introducing a strain increment into the workpiece and producing a change in an overall dimension of the workpiece due to the strain increment, the chemical component being oxygen or nitrogen.

41. The method of claim 40 wherein the workpiece is of a material susceptible to a phase transition, upon change in concentration therein of the chemical component and at a temperature, further comprising the step of bringing the workpiece to the temperature, altering the concentration in the workpiece of the chemical component comprising alternately providing the chemical component to and removing the chemical component from the workpiece.

42. The method of claim 41 wherein the material includes a phase of iron, zirconium, titanium, or yttrium or of an alloy based thereon.

43. The method of claim 41 wherein the material includes a phase of an oxide ceramic or a nitride ceramic.

* * * * *